US009367997B2

(12) United States Patent
LaDuca

(10) Patent No.: US 9,367,997 B2
(45) Date of Patent: Jun. 14, 2016

(54) DOUBLE DRAW POKER CASINO CARD GAME

(71) Applicant: AGS, LLC, Las Vegas, NV (US)

(72) Inventor: Ronald LaDuca, Ledyard, CT (US)

(73) Assignee: AGS, LLC, Las Vegas, NV (US)

( * ) Notice: Subject to any disclaimer, the term of this patent is extended or adjusted under 35 U.S.C. 154(b) by 53 days.

(21) Appl. No.: 13/779,547

(22) Filed: Feb. 27, 2013

(65) Prior Publication Data

US 2014/0087803 A1 Mar. 27, 2014

(51) Int. Cl.

| | |
|---|---|
| ***G07F 17/32*** | (2006.01) |
| ***A63F 1/00*** | (2006.01) |
| ***A63F 3/00*** | (2006.01) |

(52) U.S. Cl.

CPC ..... *G07F 17/3293* (2013.01); *A63F 1/00* (2013.01); *A63F 3/00157* (2013.01); *G07F 17/3244* (2013.01)

(58) Field of Classification Search

CPC ..... G07F 17/32; G07F 17/34; G07F 17/3293; A63F 2003/00164; A63F 3/08; A63F 3/00157; A63F 9/24; A63F 2001/005

USPC ..... 463/13; 273/274

See application file for complete search history.

(56) References Cited

U.S. PATENT DOCUMENTS

| | | | | |
|---|---|---|---|---|
| 4,743,022 | A | 5/1988 | Wood | |
| 4,926,327 | A | 5/1990 | Sidley | |
| 6,102,402 | A | 8/2000 | Scott et al. | |
| 6,315,664 | B1 | 11/2001 | Baerlocher et al. | |
| 6,402,147 | B1 | 6/2002 | Lo | |
| 6,416,407 | B1 * | 7/2002 | Carrico et al. | 463/13 |
| 6,540,230 | B1 | 4/2003 | Walker et al. | |
| 6,581,936 | B1 | 6/2003 | Zoccolillo et al. | |
| 6,679,497 | B2 | 1/2004 | Walker et al. | |
| 6,755,741 | B1 | 6/2004 | Rafaeli | |
| 6,783,457 | B2 | 8/2004 | Hughs-Baird et al. | |
| 6,827,348 | B1 | 12/2004 | Mitchell | |
| 6,991,538 | B2 | 1/2006 | Cannon | |
| 7,121,550 | B1 | 10/2006 | Lo | |
| 7,137,628 | B2 | 11/2006 | Moody | |
| 7,156,397 | B2 | 1/2007 | Moody et al. | |
| 7,311,597 | B2 | 12/2007 | Thomas | |

(Continued)

OTHER PUBLICATIONS

"Variations of 5 Card Draw Poker—5 Card Draw Poker Info," 5card-drawpoker.net, http://www.5carddrawpoker.net/variations-of--5-card-draw-poker.php, (Feb. 4, 2012), 2 pages.

(Continued)

*Primary Examiner* — James S McClellan
*Assistant Examiner* — Kevin Carter
(74) *Attorney, Agent, or Firm* — Weide & Miller, Ltd.

(57) ABSTRACT

A method for playing a double draw poker casino card game comprises providing a standard fifty-two card deck of playing cards and two joker cards shuffled together with the standard fifty-two card deck. Each of the two joker cards is valued as an ace, as a fill-in card for a straight, or as a fill-in card for a flush. Each player places an ante bet and a bonus bet and receives five dealt cards. Each player folds or makes a first optional draw card bet and discards and draws up to three draw cards. Each player folds or makes a second optional draw card bet and discards and draws up to one draw card, producing a final double draw five card poker hand that receives a payout against a first payout table, for the ante bet and draw bets, and against a second payout table for the bonus bet.

30 Claims, 7 Drawing Sheets

(56) References Cited

U.S. PATENT DOCUMENTS

| | | | | |
|---|---|---|---|---|
| 7,661,676 | B2 | 2/2010 | Smith et al. | |
| 7,704,136 | B2 | 4/2010 | Shackleford et al. | |
| 7,766,332 | B2 | 8/2010 | Grauzer et al. | |
| 7,803,043 | B2 | 9/2010 | Jackson | |
| 7,850,522 | B2 | 12/2010 | Walker et al. | |
| 7,901,285 | B2 | 3/2011 | Tran et al. | |
| 7,993,191 | B2 | 8/2011 | Evans et al. | |
| 8,070,574 | B2 | 12/2011 | Grauzer et al. | |
| 8,142,283 | B2 | 3/2012 | Lutnick et al. | |
| 8,177,619 | B2 | 5/2012 | Jackson | |
| 8,187,071 | B1 | 5/2012 | Shackleford et al. | |
| 8,202,150 | B2 | 6/2012 | Berman et al. | |
| 8,210,532 | B2 | 7/2012 | Evans et al. | |
| 8,210,533 | B2 | 7/2012 | Evans et al. | |
| 8,262,475 | B2 | 9/2012 | Snow et al. | |
| 8,272,958 | B2 | 9/2012 | Smith et al. | |
| 8,323,085 | B2 | 12/2012 | Berman et al. | |
| 8,480,471 | B2 | 7/2013 | Lutnick et al. | |
| 2002/0190469 | A1 | 12/2002 | Conklin et al. | |
| 2003/0104851 | A1 | 6/2003 | Merari | |
| 2004/0075215 | A1* | 4/2004 | Snow et al. | 273/292 |
| 2004/0100025 | A1 | 5/2004 | Conklin et al. | |
| 2004/0160008 | A1* | 8/2004 | Sawyer | 273/292 |
| 2005/0001378 | A1* | 1/2005 | Lo | 273/292 |
| 2005/0059451 | A1* | 3/2005 | Shackleford | 463/13 |
| 2005/0164759 | A1 | 7/2005 | Smith et al. | |
| 2005/0261056 | A1 | 11/2005 | Smolucha | |
| 2006/0194629 | A1 | 8/2006 | Strom | |
| 2007/0228656 | A1 | 10/2007 | Jackson | |
| 2010/0038849 | A1 | 2/2010 | Scheper et al. | |
| 2010/0222122 | A1* | 9/2010 | Vang et al. | 463/11 |
| 2010/0289220 | A1 | 11/2010 | Jackson | |
| 2011/0115160 | A1 | 5/2011 | Snow | |
| 2013/0053117 | A1 | 2/2013 | Snow | |
| 2013/0184059 | A1 | 7/2013 | Costello et al. | |
| 2013/0184079 | A1 | 7/2013 | Costello et al. | |
| 2013/0296025 | A1 | 11/2013 | Castle, II et al. | |

OTHER PUBLICATIONS

"Draw Poker," Wikipedia, http://en.wikipedia.org/wiki/Draw_poker, (Dec. 4, 2003), 6 pages.

Double Draw Poker—Wizard of Odds, "The Wizard of Odds, Double Draw Poker", http://wizardofodds.com/games/video-poker/tables/double-draw/, Copyright © 1998-2015 Wizard of Odds Consulting, Inc., Nov. 10, 2006, 3 pages, author unknown.

* cited by examiner

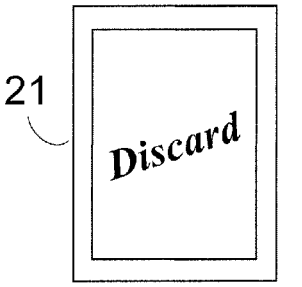
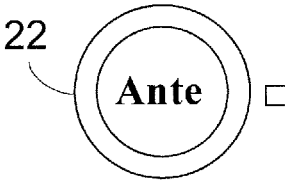
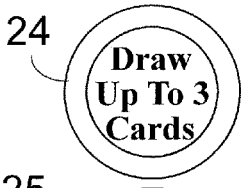
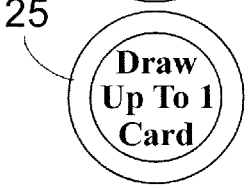
Straight Flush.....30 to 1
4 of a Kind.....20 to 1
Full House.....5 to 1
Flush.....3 to 1
Straight.....2 to 1
3 of a Kind.....PUSH
2 Pair.....PUSH
FIG. 5
ANTE AND DRAW BETS
Pay 1 to 1
3 of a Kind or Better
26B
BONUS PAYS
5 Aces.....500 to 1
Natural Royal Flush..100 to 1
Straight Flush.....50 to 1
4 of a Kind.....20 to 1
Full House.....5 to 1
Flush.....3 to 1
Straight.....2 to 1
3 of a Kind.....PUSH
2 Pair.....PUSH
37B
FIG. 4
ANTE AND DRAW BETS
Pay 1 to 1
3 of a Kind or Better
36B (continued in FIG. 9B)

DOUBLE DRAW POKER CASINO CARD GAME

CROSS-REFERENCE TO RELATED APPLICATION

This application claims the benefit of U.S. Provisional Patent Application Ser. No. 61/744,339 filed Sep. 24, 2012.

TECHNICAL FIELD

The present disclosure relates to a method for playing a double draw poker casino card game. The method comprises providing a standard fifty-two card deck of playing cards for playing a standard draw poker casino card game and further providing two joker cards shuffled together with the standard fifty-two card deck. Each of the two joker cards is valued as an ace, as a fill-in card for a straight, or as a fill-in card for a flush. Each player places an ante bet and a bonus bet and receives five dealt cards. The player may make a first optional draw card bet and discard and draw up to three draw cards. The player may make a second optional draw card bet and discard and draw up to one draw card, producing a final double draw five card poker hand that receives a payout against a first payout table for the ante bet and draw bets and a second payout table for the bonus bet.

BACKGROUND

Part of the excitement of poker card games is to be dealt a high scoring hand to win in a game of poker. Draw poker, with a single draw of up to three cards, further increases the chance of being dealt a high scoring hand and, hence, the enticement to play and to bet on a five card poker hand.

Playing poker against other players with unlimited betting and raising opportunities increases the excitement of playing poker but does not increase the chance of winning a hand, which may sometimes last for many long rounds of betting and raising.

There is also an element of bluffing or using other tactics to win in a game of poker played against other players such that the highest scoring poker hand does not always win.

It is desirable to increase a player's chances of winning, to provide quicker games to allow a player more chances to win in a given time period, and to provide a game wherein there is a certainty of winning a specific amount of money for each specific five card poker hand.

BRIEF SUMMARY

An object of the present invention is to provide a method of playing a double draw five card poker casino card game having a first optional draw of up to three cards and a second optional draw of up to one card to increase a player's chances of producing a high scoring five card poker hand by having two draws, instead of one draw, to improve a five card poker hand.

Another object of the present invention is to provide a method for playing a double draw five card casino poker game in which a payout is paid out against two specified payout tables with specific returns for specific five card poker hands for a fast and certain outcome for a player, thereby increasing the speed of the poker game, eliminating bluffing and other player strategies, which occur when trying to beat poker hands held by other players, and providing the certainty of knowing what the payout will be for each five card poker hand.

In brief, a method for a double draw poker casino card game of the present invention comprises a player receiving five dealt cards and having a first optional draw opportunity; discarding and drawing up to three draw cards, and having a second optional draw opportunity; discarding and drawing up to one draw card; producing a final double draw five card poker hand receiving a payout against a first payout table for the ante bet and draw bets and a second payout table for the bonus bet.

The method of the present invention of playing a double draw poker casino card game comprises:

a) a first act of providing a standard fifty-two card deck of playing cards for playing a standard draw poker casino card game and further providing two joker cards shuffled together with the standard fifty-two card deck, each of the two joker cards valued as an ace, as a fill-in card for a straight, or as a fill-in card for a flush;

b) a second act of placing an ante bet in a first location in front of each player;

c) a third act of placing a mandatory bonus bet in a second location in front of each player;

d) a fourth act of dealing five cards face down to each player;

e) a fifth act of the player viewing the player's own five dealt cards;

f) a sixth act of exercising an option to fold the player's own five dealt cards and forfeiting the player's ante bet and bonus bet, thereby ending the folding player's game for the hand; or an alternate sixth act of exercising an alternate option of placing, in a third location in front of the player, a first draw bet to discard and draw up to three cards;

g) a seventh act of discarding and drawing from zero to three cards thereby holding a five card hand;

h) an eighth act of exercising an option to fold the player's own held five card hand and forfeiting the player's ante bet, bonus bet, and first draw bet, thereby ending the folding player's game for the hand; or an alternate eighth act of exercising an alternate option of placing, in a fourth location in front of the player, a second draw bet to discard and draw up to one card;

i) a ninth act of discarding and drawing from zero to one card thereby holding a final five card hand;

j) a tenth act of paying out on the final five card hand for each player according to a first payout table, for the ante bet and draw bets, and a second payout table, for the bonus bet.

An advantage of the present invention is that it provides an opportunity to build higher scoring five card poker hands.

Another advantage of the present invention is that it provides a fast game of five card poker with definite specified payouts for different five card poker hands.

An added advantage of the present invention is that it provides three betting opportunities for a player.

BRIEF DESCRIPTION OF THE DRAWINGS

These and other details of the present invention will be described in connection with the accompanying drawings, which are furnished only by way of illustration and not in limitation of the invention, and in which drawings:

FIG. 4 is an enlarged plan view showing a second embodiment of the double draw poker casino card game playing table payout tables facing the dealer (appearing upside-down to the players);

FIG. 5 is an enlarged plan view showing a second embodiment of a player layout and payout tables of the double draw poker casino card game playing table facing a player;

DETAILED DESCRIPTION

In FIGS. 1-9, a method for a double draw poker casino card game includes a player receiving five dealt cards and having a first optional draw opportunity; discarding and drawing up to three draw cards, and having a second optional draw opportunity; discarding and drawing up to one draw card; producing a final double draw five card poker hand that receives a payout according to a first payout table 26/36, for an ante bet and draw bets, and a payout according to a second payout table 27/37, for a bonus bet.

Figure 1:
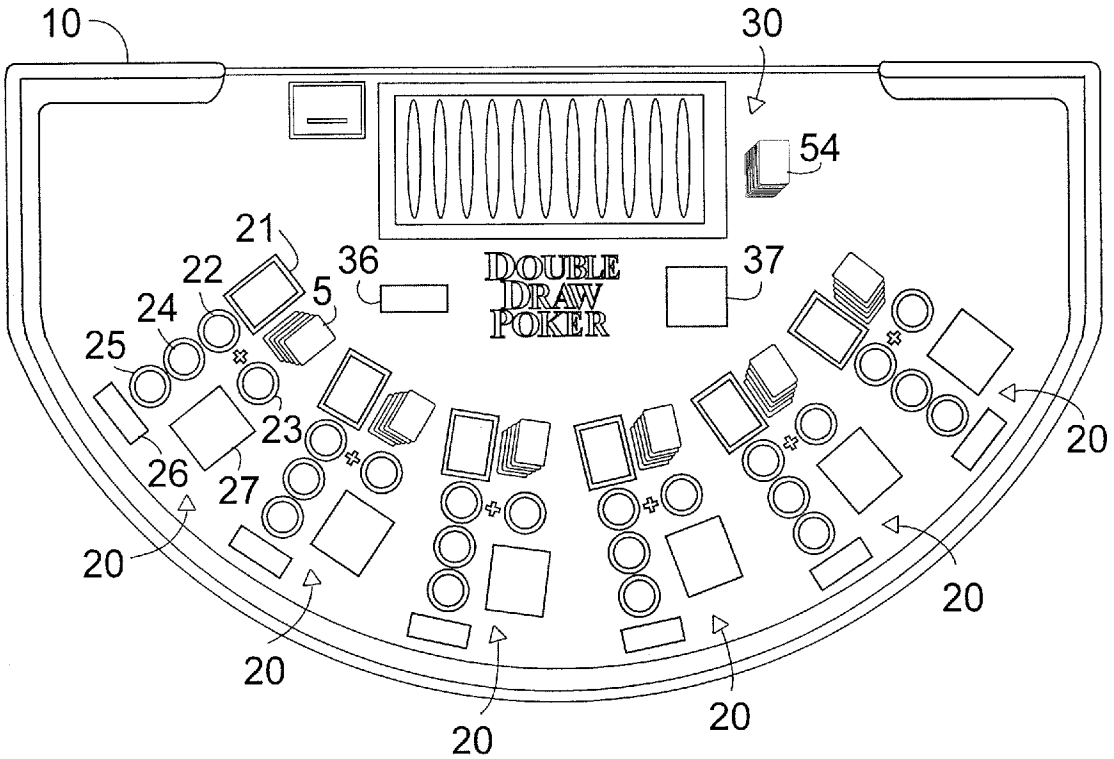
FIG. 1 is a plan view showing a double draw poker casino card game playing table showing the player layouts and pay tables facing the players and the dealer layout and pay tables facing the dealer on the other side of the playing table from the players.

In FIGS. 1-5 and 9, the method of playing a double draw poker casino card game comprises:

a) a first act of providing a standard fifty-two card deck of playing cards for playing a standard draw poker casino card game and further providing two joker cards shuffled together with the standard fifty-two card deck to make a fifty-four deck 54, as shown in FIG. 1, each of the two joker cards valued as an ace, as a fill-in card for a straight, or as a fill-in card for a flush;

b) a second act of placing an ante bet in a first bet location 22 in front of each player in a player layout 20;

c) a third act of placing a mandatory bonus bet in a second bet location 23 in front of each player;

d) a fourth act of dealing five cards 5 face down to each player;

e) a fifth act of the player viewing the player's own dealt five cards 5;

f) a sixth act of exercising an option to fold the player's own dealt five cards 5 and forfeit the player's ante bet and bonus bet, thereby ending the folding player's game for the hand; or an alternate sixth act of exercising an alternate option to place, in a third bet location 24 in front of the player, a first draw bet to discard and draw up to three cards;

g) a seventh act of discarding, onto a discard location 21 in front of the player, and drawing from the deck 54 from zero to three cards, thereby holding a five card hand;

h) an eighth act of exercising an option to fold the player's own held five card hand and forfeit the player's ante bet, bonus bet, and first draw bet, thereby ending the folding player's game for the hand; or an alternate eighth act of exercising an alternate option to place, in a fourth bet location 25 in front of the player, a second draw bet to discard and draw up to one card;

i) a ninth act of discarding onto the discard location 21, in front of the player, and drawing from the deck 54 from zero to one card, thereby holding a final five card hand;

j) a tenth act of paying out on the final five card hand for each player according to the first payout table 26/36, for the ante bet and draw bets, and according to the second payout table 27/37, for the bonus bet.

In the third act, placing a mandatory bonus bet preferably comprises placing a bonus bet equal to the ante bet.

In the alternate sixth act, exercising an alternate option to place a first draw bet preferably comprises placing a first draw bet equal to the ante bet.

In the alternate eighth act, exercising an alternate option to place a second draw bet preferably comprises placing a second draw bet equal to the ante bet.

Figures 2, 3:
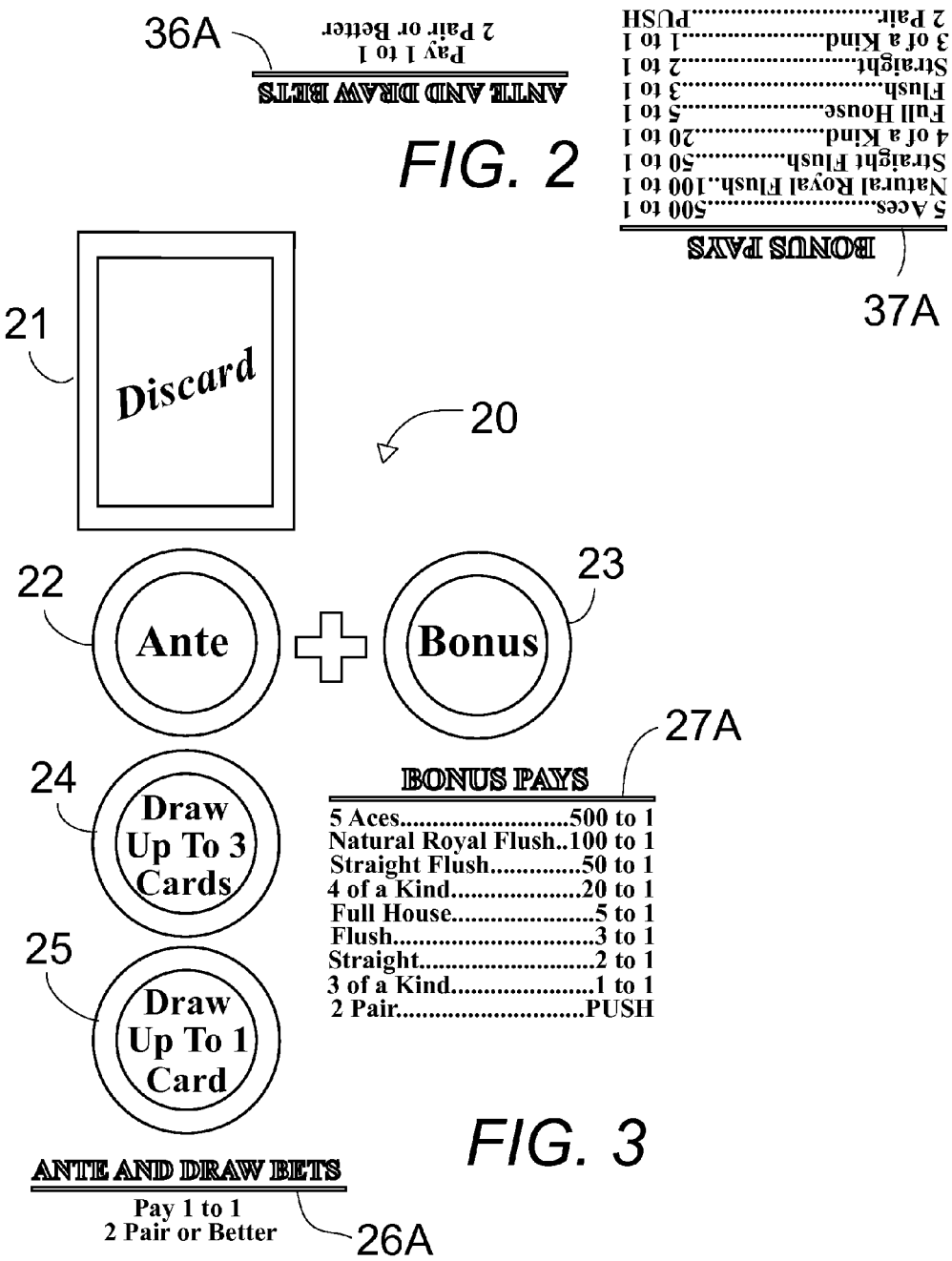
FIG. 2 is an enlarged plan view showing a first embodiment of the double draw poker casino card game playing table payout tables facing the dealer (appearing upside-down to the players)
FIG. 3 is an enlarged plan view showing a first embodiment of a player layout and payout tables of the double draw poker casino card game playing table facing a player.

In FIGS. 2-3, the tenth act comprises paying out, on the final five card hand for each player, according to a first payout table 26A/36A by paying out, for the ante bet and each draw bet, 1 to 1 for two pair or better, and according to a second payout table 27A/37A by paying out, for the bonus bet, 500 to 1 for five aces, 100 to 1 for a natural royal flush, 50 to 1 for a straight flush, 20 to 1 for a four of a kind, 5 to 1 for a full house, 3 to 1 for a flush, 2 to 1 for a straight, 1 to 1 for a three of a kind, and push for two pair.

In FIGS. 4-5, the tenth act comprises paying out, on the final five card hand for each player, according to a first payout table 26B/36B by paying out, for the ante bet and each draw bet, 1 to 1 for two pair or better, and according to a second payout table 27B/37B by paying out, for the bonus bet, 500 to 1 for five aces, 100 to 1 for a natural royal flush, 50 to 1 for a straight flush, 20 to 1 for a four of a kind, 5 to 1 for a full house, 3 to 1 for a flush, 2 to 1 for a straight, push for a three of a kind, and push for two pair.

In FIGS. 1-5, the method comprises an act of providing a casino gaming table 10 for playing the double draw poker casino card game. Each player carries out the acts of the double draw poker casino card game by sitting at the casino gaming table 10 with other players, each in front of the player layout 20, and a dealer in front of a dealer layout 30. Each player further carries out the acts of the method of the double draw poker casino card game by physically playing with the five cards 5, dealt by the dealer from the deck of fifty-four cards 54, which deck 54 includes two jokers, and physically placing bets on the first bet location 22, the second bet location 23, the third bet location 24, and the fourth bet location 25 (also referred to herein, respectively, as designated ante location 22, bonus location 23, and draw locations 24 and 25) on the player layout 20, in front of each player, in a double draw poker casino card game, which player layout 20 is shown in detail in FIGS. 3 and 5. Bets and payouts may be made using poker chips, other tokens of monetary value, or actual money.

In FIGS. 1-8, the method may alternately comprise an act of providing a simulation device for playing the double draw poker casino card game. A player may carry out the acts of the double draw poker casino card game, using the simulation device, by manipulating the simulation device by placing simulation bets on the designated ante location 22, the bonus location 23, and the draw locations 24 and 25 in a double draw poker casino card game player layout, on the simulation device, which player layout may be similar to the player layouts 20 of the casino table 10 of FIG. 1.

In FIGS. 1-5, the method may alternately comprise an act of providing a mechanical simulation device, such as a game board similar to the casino table 10, for playing the double draw poker casino card game. The method utilizing the game board comprises an additional act of selecting a player/dealer to sit in front of the dealer layout 30 to deal the cards and make the payouts. The players may alternate being the player/dealer. The method of playing the double draw casino poker game on the mechanical simulation device comprises each player carrying out the acts of the double draw poker casino card game using the mechanical simulation device by physically playing with the five cards 5 dealt by a player dealer from the fifty-four card deck 54 and physically placing bets on the designated ante location 22, the bonus location 23, and the draw locations 24 and 25 on the double draw poker casino card game player layout 20 in front of each player on the mechanical simulation device. Similar to the method played on an actual casino gaming table (e.g., the casino gaming table 10), bets and payouts may be made using poker chips, other tokens of monetary value, or actual money in the method using the game board.

Figure 6:
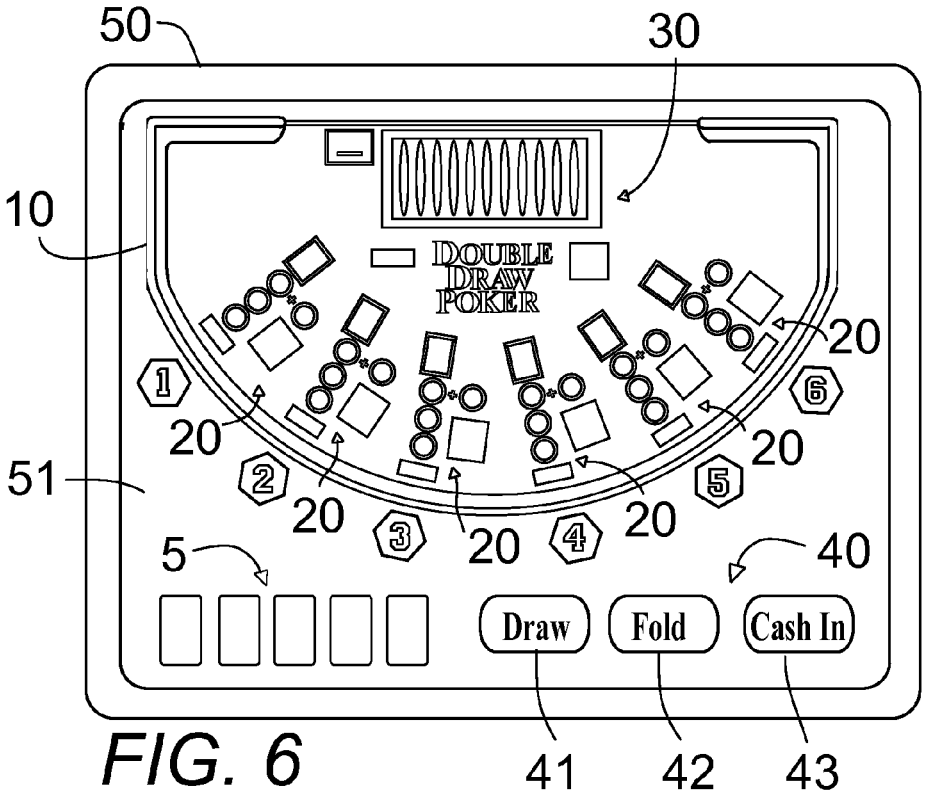
FIG. 6 is an elevational view of a simulation of the double draw poker casino card game playing table layout, shown on a screen of an electronic simulation device and showing a simulation of the player layouts and pay tables, the dealer layout and pay tables, and the five cards held by a player.
Figure 7:
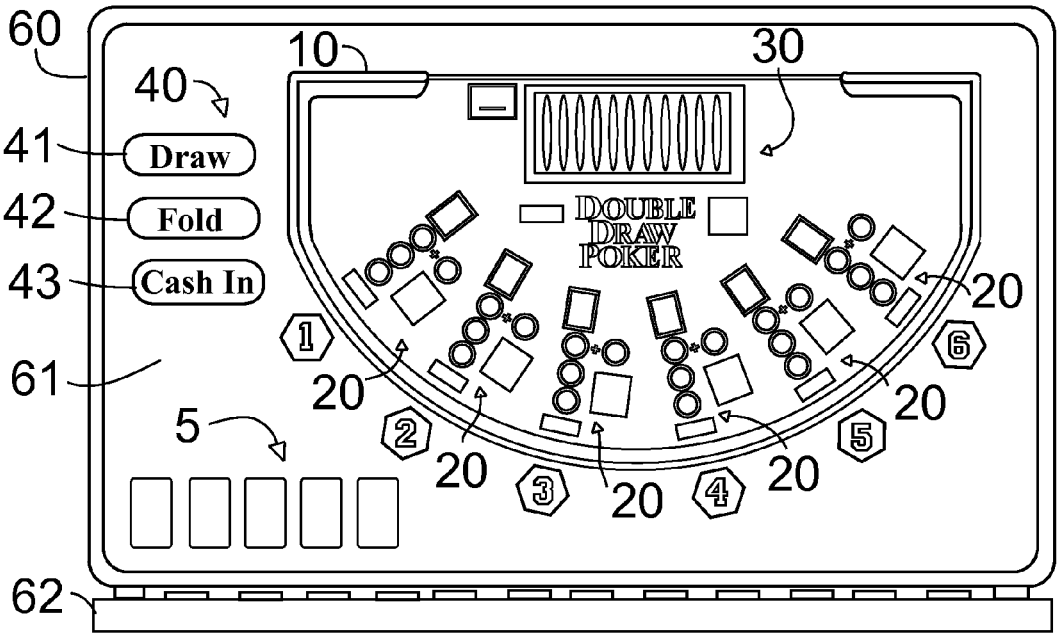
FIG. 7 is an elevational view of a simulation of the double draw poker casino card game playing table layout, shown on a screen of a computer device and showing a simulation of the player layouts and pay tables, the dealer layout and pay tables, and the five cards held by a player.
Figure 8:
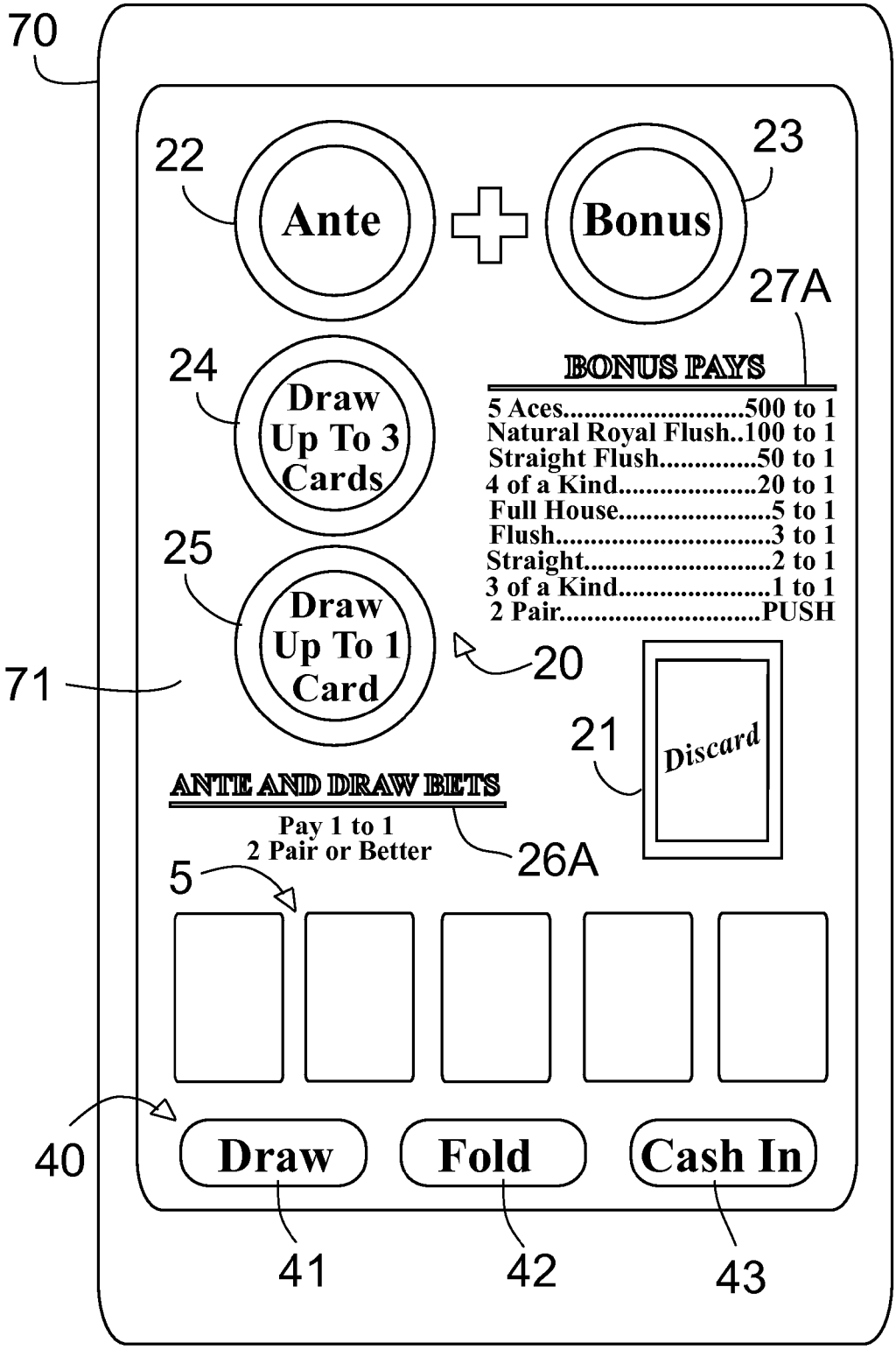
FIG. 8 is an elevational view of a simulation of a player layout for the double draw poker casino card game playing table layout, shown on a screen of a wireless device and showing a simulation of the player layouts and pay tables and the five cards held by a player.
Figure 9A:
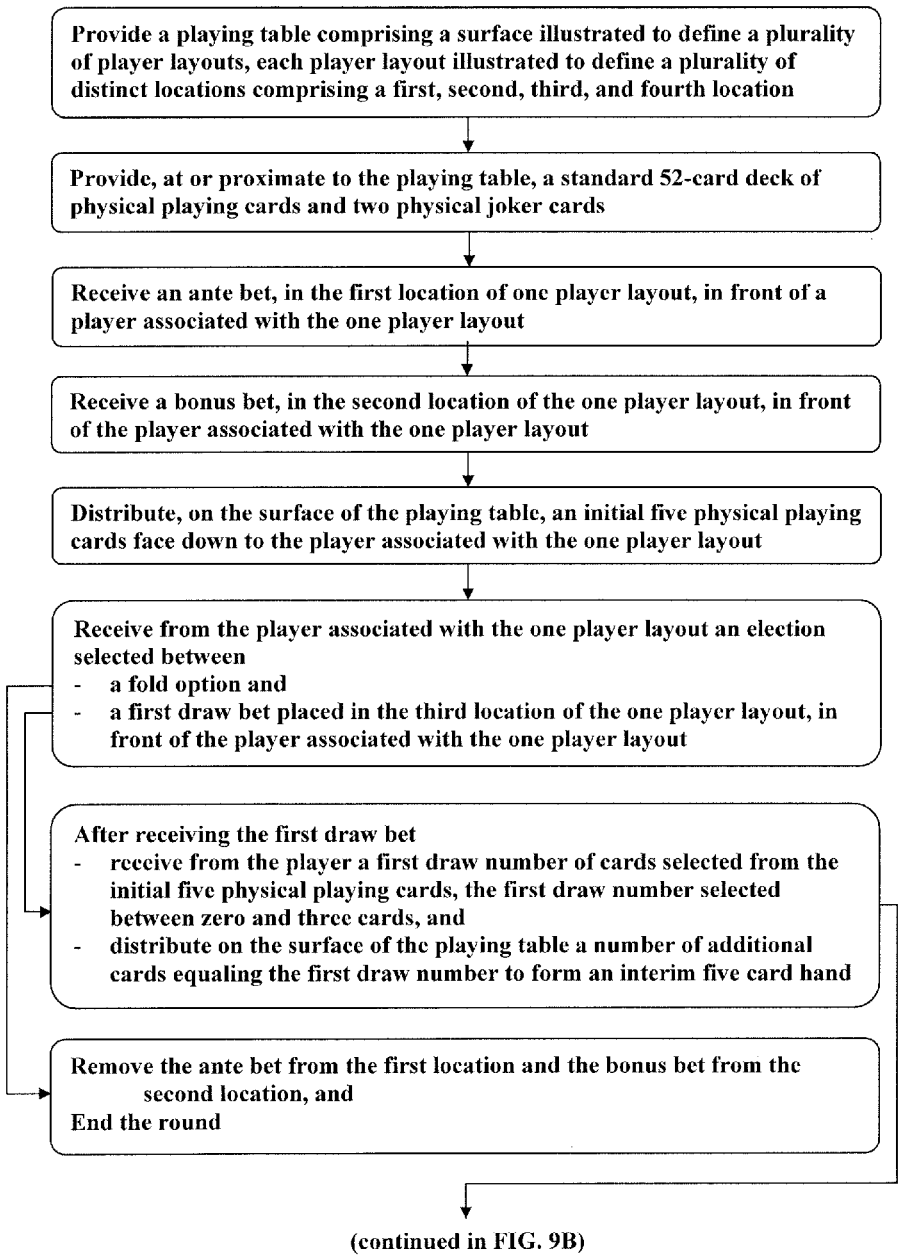
FIGS. 9A and 9B show a flow diagram for a method according to an embodiment of the present disclosure, FIG. 9B continuing from FIG. 9A.
Figure 9B:
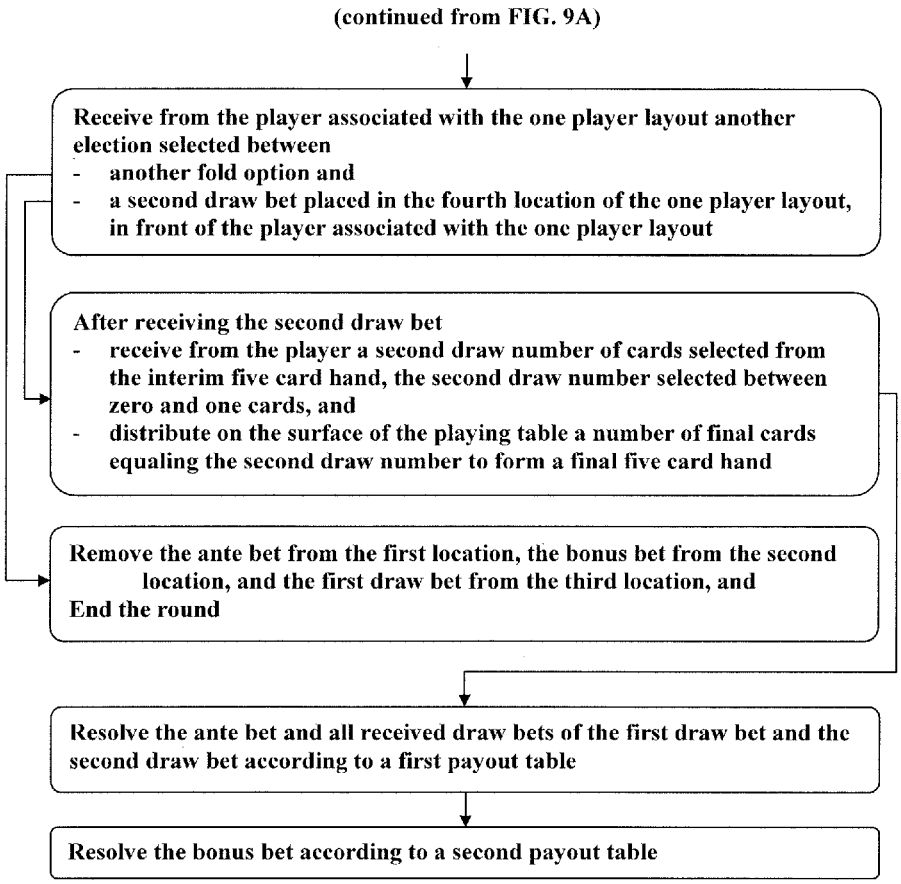

In FIGS. 6-8, the method comprises an act of providing an electronic simulation device 50, 60, or 70 for playing the double draw poker casino card game. The electronic simulation device 50, 60, or 70 comprises a screen 51, 61, or 71 showing a virtual representation of the five cards 5 dealt to a player and showing a virtual representation of at least one double draw poker casino card game player layout 20. The electronic simulation device 50, 60, or 70 further comprises means for a player to interact with the electronic simulation device 50, 60, or 70. Each player carries out the acts of the double draw poker casino card game using the electronic simulation device 50, 60, or 70 by inputting commands on the designated ante location 22, bonus location 23, and draw locations 24 and 25 (collectively also referred to herein as the betting locations 22, 23, 24, and 25), on the hand of the five cards 5, and on additional inputting locations 40, including a draw location 41, a fold location 42, and a cash in location 43. Virtual bets are input to the designated ante location 22, bonus location 23, and draw locations 24 and 25 in the virtual double draw poker casino card game player layout on the screen 51, 61, or 71. After inputting a command for a bet in a first draw location (e.g., the draw location 24), a player inputs commands to indicate which zero to three virtual cards of the five cards 5 are to be discarded and replaced by virtual draw cards by inputting commands to touch any cards to be discarded from the five card hand 5 and then a command to contact the discard location 21 and then contact the draw location 41. Alternatively, the hand may be folded by inputting a command to contact the fold location 42. After receiving the draw cards to replace the discard cards, a command may be input for a bet in a second draw location 25 (e.g., the draw location 25). A player inputs commands to indicate which zero to one virtual cards of the hand of five cards 5 are to be discarded and replaced by a virtual draw card by optionally inputting a command to touch the card to be discarded from the five card hand 5, then a command to contact the discard location 21, and then a command to contact the draw location 41. Alternately, the hand may be folded by inputting a command to contact the fold location 42. After all optional draws have been made and the final five card hand of cards 5 is complete, the method includes cashing in by inputting a command to contact the cash in location 43.

In FIG. 6, an embodiment of the method of the present invention comprises an act of providing the electronic device 50, which may be a television or other entertainment or communication device, a gaming device, a computer device, or other electronic simulation device having a viewing screen (e.g., the screen 51), showing the entire simulation of the double draw poker casino card game with the dealer layout 30 and the player layouts 20, each indicated by a player number of one to six inside of a hexagon in front of the player layout 20, for inputting a command to contact the desired player location hexagon for each player, as well as having the additional inputting locations 40. The method of play is carried out according to the method indicated above for the electronic simulation device 50, 60, or 70. The acts involving inputting commands are accomplished by using controls for inputting commands found on gaming devices, computer devices, television and other entertainment and communication devices, or other electronic simulation device controls.

In FIG. 7, an embodiment of the method of the present disclosure comprises an act of providing a computer device (e.g., the electronic simulation device 60), which may be a laptop, a desktop, or other computer device having a keyboard 62 and having a viewing screen (e.g., the screen 61), showing the entire simulation of the double draw poker casino card game, with the dealer layout 30 and the player layouts 20, each indicated by a player number of one to six inside of a hexagon in front of the player layout 20, for inputting a command to contact the desired player location hexagon for each player, as well as having the additional inputting locations 40. The method of play is carried out according to the method indicated above for the electronic simulation device 50, 60, or 70. The acts involving inputting commands are accomplished by using keyboard controls, a mouse, or other computer input controls for inputting commands to carry out the acts of the method.

In FIG. 8, an embodiment of the method of the present disclosure comprises an act of providing a handheld electronic simulation device (e.g., the electronic simulation device 70) for playing the double draw poker casino card game. The handheld electronic simulation device (e.g., the electronic simulation device 70) comprises a touch screen (e.g., the screen 71) as a means for interacting with the handheld electronic simulation device (e.g., the electronic simulation device 70. A player touches the screen 71 to play the game using the method of the present invention wherein all of the inputting as indicated above is accomplished by touching the screen 71 in each of the desired locations. The handheld device (e.g., the electronic simulation device 70) may be a smart phone, a handheld gaming device, or other communication or entertainment devices. The display screen (e.g., the screen 71) indicates a virtual display of the player layout 20, as well as has the additional inputting locations 40. The method of carrying out the embodiment of the method of the game is accomplished by inputting commands by touching the screen 71 according to the method indicated above for electronic simulation devices 50, 60, 70.

The act of providing an electronic simulation device may comprise providing an electronic simulation device having a connection to a remote network for playing the double draw poker casino card game, wherein a player uses the electronic simulation device having the connection to the remote network to play the game using an embodiment of the method of the present disclosure.

The act of providing an electronic simulation device may comprise providing an electronic simulation device having a wired connection to a remote network for playing the double draw poker casino card game, wherein a player uses the electronic simulation device having the wired connection to the remote network to play the game using an embodiment of the method of the present disclosure.

The act of providing an electronic simulation device may comprise providing an electronic simulation device having a wireless connection to a remote network for playing the double draw poker casino card game, wherein a player uses the electronic simulation device having the wireless connection to the remote network to play the game using an embodiment of the method of the present disclosure.

The act of providing a communication electronic simulation device may comprise providing a communication electronic simulation device having a connection to a remote network for playing the double draw poker casino card game, wherein a player uses the communication electronic simulation device having the connection to the remote network to play the game using an embodiment of the method of the present disclosure.

The method, wherein a player uses the electronic simulation device having the connection to the remote network for playing the double draw poker casino card game using an embodiment of the method of the present disclosure comprises using a device taken from the list of electronic simulation devices comprising a computer, a handheld device, a telephonic device, an entertainment device, a gaming device, and a television device.

In use, the present method comprises a first act of providing a standard fifty-two card deck of playing cards for playing a standard draw poker casino card game and providing two joker cards shuffled together with the standard fifty-two card deck, each of the two joker cards being valued as an ace, as a fill-in card for a straight, or as a fill-in card for a flush. The method further comprises acts of each player placing an ante bet and a bonus bet and receiving five dealt cards. The method then comprises acts of each player either folding or making a first optional draw card bet and discarding and drawing up to three draw cards. The method then comprises acts of each player folding or making a second optional draw card bet and discarding and drawing up to one draw card, producing a final double draw five card poker hand. The method comprises a final act of each player having the final double draw five card poker hand receiving a payout against a first payout table, for the ante bet and draw bets, and against a second payout table, for the bonus bet.

It is understood that the preceding description is given merely by way of illustration, not in limitation of the invention, and that various modifications may be made thereto without departing from the spirit of the invention as claimed.

What is claimed is:

1. A method of administering a double draw poker casino card game, the method comprising:

providing a playing table comprising a surface illustrated to define a plurality of player layout areas, each player layout area of the plurality of player layout areas illustrated to define a plurality of distinct betting locations comprising a first betting location, a second betting location, a third betting location, and a fourth betting location;

providing at or proximate to the playing table a standard 52-card deck of physical playing cards and further providing at or proximate to the playing table two physical joker cards randomized with the standard 52-card deck of physical playing cards to form a 54-card deck of physical playing cards, each of the two physical joker cards designated to be valued as any of an ace, a fill-in card for a straight, and a fill-in card for a flush;

receiving an ante bet, in the form of at least one chip placed in the first betting location of one player layout area of the plurality of player layout areas;

receiving a bonus bet, in the form of at least one chip placed in the second betting location of the one player layout area;

distributing, on the surface of the playing table and from the 54-card deck of physical playing cards, an initial five physical playing cards face down to the player associated with the one player layout area;

after distributing the initial five physical playing cards, receiving from the player associated with the one player layout area an election selected between a fold option, and a first draw bet in the form of at least one chip placed in the third betting location of the one player layout area, the first draw bet designated to be resolved based on a final five card hand associated with the player;

after receiving from the player the election selected to be the first draw bet:

receiving from the player a first draw number of discarded cards selected from the initial five physical playing cards, the first draw number selected by the player from a first predefined range of zero to three cards; and after receiving from the player the first draw number of discarded cards, distributing, on the surface of the playing table and from the 54-card deck of physical playing cards, a number of replacement cards equaling the first draw number, selected from the first predefined range of zero to three cards, to form an interim five card hand;

after distributing the number of replacement cards equaling the first draw number to form the interim five card hand, receiving from the player associated with the one player layout area another election selected between another fold option, and a second draw bet in the form of at least one chip placed in the fourth betting location of the one player layout area, the second draw bet designated to be resolved based on the final five card hand associated with the player;

after receiving from the player the another election selected to be the second draw bet:

receiving from the player a second draw number of discarded cards selected from the interim five card hand, the second draw number selected by the player from a second predefined range of zero to one cards; and after receiving from the player the second draw number of discarded cards, distributing, on the surface of the playing table and from the 54-card deck of physical playing cards, a number of final replacement cards equaling the second draw number, selected from the second predefined range of zero to one cards, to form the final five card hand associated with the player;

resolving the ante bet and all received draw bets of the first draw bet and the second draw bet according to a first payout table; and resolving the bonus bet according to a second payout table.

2. The method of claim 1, wherein receiving a bonus bet comprises receiving a bonus bet equal to the ante bet.

3. The method of claim 1, wherein receiving from the player associated with the one player layout area an election selected between a fold option and a first draw bet comprises receiving from the player associated with the one player layout area the election selected between the fold option and a first draw bet equal to the ante bet.

4. The method of claim 1, wherein receiving from the player associated with the one player layout area another election selected between another fold option and a second draw bet comprises receiving from the player associated with the one player layout area the another election selected between the another fold option and a second draw bet equal to the ante bet.

5. The method of claim 1, wherein:

resolving the ante bet and all received draw bets of the first draw bet and the second draw bet comprises resolving the ante bet and all received draw bets of the first draw bet and the second draw bets according to a first payout table defining a first payout of 1 to 1 for at least two pair in the final five card hand; and resolving the bonus bet comprises resolving the bonus bet according to a second payout table defining a second payout of 500 to 1 for five aces, 100 to 1 for a natural royal flush, 50 to 1 for a straight flush, 20 to 1 for four of a kind, 5 to 1 for a full house, 3 to 1 for a flush, 2 to 1 for a straight, 1 to 1 for three of a kind, and push for two pair in the final five card hand.

6. The method of claim 1, wherein:

resolving the ante bet and all received draw bets of the first draw bet and the second draw bet comprises resolving the ante bet and all received draw bets of the first draw bet and the second draw bets according to a first payout table defining a first payout of 1 to 1 for at least two pair in the final five card hand; and resolving the bonus bet comprises resolving the bonus bet according to a second payout table defining a second payout of 500 to 1 for five aces, 100 to 1 for a natural royal flush, 50 to 1 for a straight flush, 20 to 1 for four of a kind, 5 to 1 for a full house, 3 to 1 for a flush, 2 to 1 for a straight, push for three of a kind, and push for two pair in the final five card hand.

7. The method of claim 1, wherein providing a playing table comprises providing a simulation device comprising the surface displaying an illustration to define the plurality of player layout areas.

8. The method of claim 7, wherein providing a simulation device comprises providing a mechanical simulation device.

9. A method of administering a double draw poker casino card game, the method comprising:

providing an electronic simulation device comprising a screen configured to display a virtual representation of a surface illustrated to define a plurality of player layout areas, each player layout area of the plurality of player layout areas illustrated to define a plurality of distinct betting locations comprising a first betting location, a second betting location, a third betting location, and a fourth betting location, the electronic simulation device configured to receive commands inputted by a player at the plurality of distinct betting locations of one player layout area of the plurality of player layout areas associated with the player;

providing a standard 52-card deck of virtual playing cards and further providing two virtual joker cards randomized with the standard 52-card deck of virtual playing cards to form a 54-card deck of virtual playing cards, each of the two virtual joker cards designated to be valued as any of an ace, a fill-in card for a straight, and a fill-in card for a flush;

receiving an ante bet, in the form of at least one virtual chip input to the first betting location of the one player layout area of the plurality of player layout areas;

receiving a bonus bet, in the form of at least one virtual chip input to the second betting location of the one player layout area;

distributing, from the 54-card deck of virtual playing cards, an initial five virtual playing cards face down to the player associated with the one player layout area;

after distributing the initial five virtual playing cards, receiving from the player associated with the one player layout area an election selected between a fold option, and a first draw bet in the form of at least one virtual chip input to the third betting location of the one player layout area, the first draw bet designated to be resolved based on a final five card hand associated with the player;

after receiving from the player the election selected to be the first draw bet:

receiving from the player a first draw number of discarded cards selected from the initial five virtual playing cards, the first draw number selected by the player from a first predefined range of zero to three cards; and after receiving from the player the first draw number of discarded cards, distributing, from the 54-card deck of virtual playing cards, a number of replacement cards equaling the first draw number, selected from the first predefined range of zero to three cards, to form an interim five card hand;

after distributing the number of replacement cards equaling the first draw number to form the interim five card hand, receiving from the player associated with the one player layout area another election selected between another fold option, and a second draw bet in the form of at least one virtual chip input to the fourth betting location of the one player layout area, the second draw bet designated to be resolved based on the final five card hand associated with the player;

after receiving from the player the another election selected to be the second draw bet:

receiving from the player a second draw number of discarded cards selected from the interim five card hand, the second draw number selected by the player from a second predefined range of zero to one cards; and after receiving from the player the second draw number of discarded cards, distributing, from the 54-card deck of virtual playing cards, a number of final replacement cards equaling the second draw number, selected from the second predefined range of zero to one cards, to form the final five card hand associated with the player, resolving the ante bet and all received draw bets of the first draw bet and the second draw bet according to a first payout table; and resolving the bonus bet according to a second payout table.

10. The method of claim 9, wherein providing an electronic simulation device comprises providing a handheld electronic simulation device, the screen of the electronic simulation device configured as a touch screen of the handheld electronic simulation device.

11. The method of claim 9, wherein providing an electronic simulation device comprises providing an electronic simulation device having a connection to a remote network.

12. The method of claim 11, wherein providing an electronic simulation device having a connection to a remote network comprises providing the electronic simulation device having a wired connection to the remote network.

13. The method of claim 11, wherein providing an electronic simulation device having a connection to a remote network comprises providing the electronic simulation device having a wireless connection to the remote network.

14. The method of claim 11, wherein providing an electronic simulation device having a connection to a remote network comprises providing a communication electronic simulation device having the connection to the remote network.

15. The method of claim 11, wherein providing an electronic simulation device comprises providing at least one of a computer, a handheld device, a telephonic device, an entertainment device, a gaming device, and a television device.

16. A method of administering a wagering game implemented in physical form on a surface of a gaming table, using wagering elements in the form of physical chips, the method comprising:

providing a gaming table comprising a surface having at least one player layout area comprising indicia designating at least four distinct betting locations on the surface, the at least four distinct betting locations comprising an ante betting location, a bonus betting location, and at least two draw betting locations;

providing at the gaming table a deck of fifty-four randomized physical playing cards, the deck comprising two jokers and a standard deck of fifty-two cards;

accepting from a player associated with the at least one player layout area an ante bet in the form of at least one chip at least partially covering the ante betting location on the surface, the ante bet designated to be resolved based at least in part on a first pay table displayed in association with the gaming table;

distributing on the surface a plurality of cards from the deck of fifty-four randomized physical playing cards forming a player hand of a number of cards equaling a number of cards for a final player hand;

absent prior receipt of a fold election and after distributing the plurality of cards forming the player hand, administering at least two post-dealing bet events, each post-dealing bet event comprising:

accepting from the player an election selected from options comprising the fold election, and a draw bet election for a draw bet in the form of at least one chip at least partially covering one of the at least two draw betting locations, acceptance of the draw bet election initiating a discard of a number of cards discarded from the player hand and distribution of replacement cards equaling the number of cards discarded from the player hand, the number of cards discarded selected by the player between zero and a predefined limit that decreases with subsequent post-dealing bet events; and resolving all accepted bets.

17. The method of claim 16, further comprising, accepting from the player associated with the at least one player layout area a bonus bet in the form of at least one other chip at least partially covering the bonus betting location on the surface, the bonus bet designated to be resolved based on a second pay table displayed in association with the gaming table.

18. The method of claim 16, wherein administering at least two post-dealing bet events comprises administering the at least two post-dealing bet events in succession, absent prior receipt of the fold election.

19. The method of claim 16, wherein resolving all accepted bets comprises:

resolving the ante bet, comprising applying the first pay table to a rank of the final player hand, the final player hand comprising at least one card of the plurality of cards distributed on the surface; and resolving all draw bets accepted during administration the at least two post-dealing bet events, comprising applying the first pay table to the rank of the final player hand.

20. A method of administering a wagering game, comprising:

providing a gaming table comprising an illustrated surface defining at least one player layout area comprising locations respectively designated for an ante bet, a bonus bet, a first draw bet, a second draw bet, and at least one discarded card;

displaying on or proximate to the gaming table a first paytable associated with the ante bet, the first draw bet, and the second draw bet; and displaying on or proximate to the gaming table a second paytable associated with the bonus bet;

receiving the ante bet in the form of at least a first token occupying an ante betting location of the locations defined at the at least one player layout area;

receiving the bonus bet in the form of at least a second token occupying a bonus betting location of the locations defined at the at least one player layout area;

providing at the gaming table a deck of physical playing cards comprising fifty-two standard physical playing cards and two jokers;

distributing from the deck of physical playing cards an initial five-card player hand;

after distributing the initial five-card player hand, administering more than one draw bet event, comprising:

accepting from a player associated with the at least one player layout area an election selected from options consisting of a fold election triggering removal of the ante bet from the ante betting location and removal of the bonus bet from the bonus betting location, and a draw bet in the form of at least a third token to occupy one of a plurality of draw betting locations of the locations defined at the at least one player layout area;

absent prior recent of the fold election, receiving on a discard location of the locations defined at the at least one player layout area a number of discard cards from the player associated with the at least one player layout area, the number of discarded cards selected between zero and a predefined limit, the predefined limit being three for an initial draw bet event of the more than one draw bet event, the predefined limit being one for a last draw bet event of the more than one draw bet event; and after receiving on the discard location the number of discard cards and after receiving the draw bet, distributing replacement cards equal to the number of discard cards to complete a five-card player hand; and after receiving at least four bets to occupy the ante betting location, the bonus betting location, and the plurality of draw betting locations:

applying the first paytable to resolve bets at the ante betting location and the plurality of draw betting locations; and applying the second paytable to resolve the bonus bet at the bonus betting location.

21. A method of administering a wagering game on a game layout with multiple player areas, comprising:

a dealer providing a set of randomized cards;

providing a gaming table comprising a game layout defined by an illustrated surface of the gaming table, the game layout defining multiple player areas, each player area comprising at least one area designated for at least one discarded card and comprising defined locations designated for wagers, the defined locations comprising a first betting location designated for an ante wager, a second betting location designated for a first draw wager, and a third betting location designated for a second draw wager;

accepting from a player the ante wager placed in the first betting location in a player area of the multiple player areas of the game layout;

dealing the player a first set of cards from the set of randomized cards, the first set of cards numbering a final number of cards for a player hand;

after dealing the player the first set of cards, accepting from the player a first election selected by the player from a fold and a first draw wager placed in the second betting location in the player area, the fold triggering the dealer to take the ante wager from the first betting location;

after accepting the first draw wager as the first election selected by the player, the dealer accepting from the player, at the at least one area designated for at least one discarded card, a first number of discarded cards selected by the player between zero and a first predefined limit less than the final number of cards;

after accepting the first draw wager and the first number of discarded cards, the dealer dealing a number of replacement cards to the player equal to the first number of discarded cards;

after dealing the number of replacement cards to the player equal to the first number of discarded cards, accepting from the player a second election selected by the player from another fold and a second draw wager placed in the third betting location in the player area, the another fold triggering the dealer to take the ante from the first betting location and to take the first draw wager from the second betting location;

after accepting the second draw wager as the second election selected by the player, the dealer accepting from the player, at the at least one area designated for at least one discarded card, a second number of discarded cards selected between zero and a second predefined limit less than the final number of cards;

after accepting the second draw wager and the second number of discarded cards, the dealer dealing another number of replacement cards to the player equal to the second number of discarded cards to form the player hand of the final number of cards;

comparing the player hand to at least one predetermined winning game outcome; and paying the player a payout on the ante wager, the first draw wager, and the second draw wager for the player hand at least equaling the at least one predetermined winning game outcome.

22. The method of claim 21, wherein dealing the player a first set of cards from the set of randomized cards comprises dealing the player the first set of cards from a standard 52-card deck of cards plus two jokers.

23. The method of claim 21, further comprising the dealer accepting from the player a bonus wager placed in a fourth betting location of the defined locations of the player area of the multiple player areas defined by the game layout.

24. The method of claim 23, wherein the dealer accepting from the player a bonus wager precedes dealing the player the first set of cards from the randomized set of randomized cards, the bonus wager designated as a mandatory wager.

25. The method of claim 23, wherein the dealer accepting from the player a bonus wager comprises the dealer accepting from the player a bonus wager equal to the ante wager.

26. The method of claim 21, wherein the dealer accepting from the player, at the at least one area designated for at least one discarded card, a first number of discarded cards comprises the dealer accepting from the player, at the at least one area designated for at least one discarded card, the first number of discarded cards selected by the player between zero and a first predefined limit of three cards.

27. The method of claim 21, wherein the dealer accepting from the player, at the at least one area designated for at least one discarded card, a second number of discarded cards comprises the dealer accepting from the player, at the at least one area designated for at least one discarded card, the second number of discarded cards selected between zero and a second predefined limit of one card.

28. The method of claim 21, wherein dealing the player a first set of cards from the set of randomized cards comprises dealing the player a first set of five cards from the set of randomized cards.

29. The method of claim 21, wherein comparing a player hand to at least one predetermined winning game outcome comprises comparing the player hand to a pay table of predetermined winning combinations and corresponding payout odds.

30. The method of claim 29, further comprising:

the dealer accepting from the player a bonus wager placed in a fourth betting location of the defined locations of the player area of the multiple player areas defined by the game layout; and comparing the player hand to bonus bet pay table of predetermined bonus winning combinations and corresponding bonus payout odds.

* * * * *